US008810594B2

(12) United States Patent
Park et al.

(10) Patent No.: US 8,810,594 B2
(45) Date of Patent: Aug. 19, 2014

(54) FOUR COLOR DISPLAY DEVICE AND METHOD OF CONVERTING IMAGE SIGNAL THEREOF

(71) Applicant: Samsung Display Co., Ltd., Yongin (KR)

(72) Inventors: Kyong-Tae Park, Suwon-si (KR); Baek-Woon Lee, Yongin-si (KR); Alexander Archipov, Suwon-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 13/658,685

(22) Filed: Oct. 23, 2012

(65) Prior Publication Data

US 2013/0083094 A1 Apr. 4, 2013

Related U.S. Application Data

(62) Division of application No. 12/411,576, filed on Mar. 26, 2009, now Pat. No. 8,305,388.

(30) Foreign Application Priority Data

Oct. 14, 2008 (KR) ..... 10-2008-0100832

(51) Int. Cl.
*G09G 5/02* (2006.01)

(52) U.S. Cl.
USPC ..... 345/589

(58) Field of Classification Search
None
See application file for complete search history.

(56) References Cited

U.S. PATENT DOCUMENTS

| | | | | |
|---|---|---|---|---|
| 5,929,843 | A * | 7/1999 | Tanioka | 345/600 |
| 7,151,517 | B2 | 12/2006 | Lee | |
| 8,063,862 | B2 * | 11/2011 | Hisatake | 345/88 |
| 2004/0222999 | A1 | 11/2004 | Choi et al. | |
| 2006/0262053 | A1 | 11/2006 | Lee et al. | |
| 2007/0146252 | A1 | 6/2007 | Miller et al. | |
| 2007/0176859 | A1 | 8/2007 | Cok et al. | |
| 2007/0286533 | A1 | 12/2007 | Harada | |
| 2008/0152219 | A1 | 6/2008 | Ramanath et al. | |
| 2008/0259099 | A1 * | 10/2008 | Arai et al. | 345/690 |
| 2010/0013748 | A1 | 1/2010 | Cok et al. | |

FOREIGN PATENT DOCUMENTS

| | | | |
|---|---|---|---|
| EP | 1475771 | A2 | 11/2004 |
| EP | 1883059 | A1 | 1/2008 |
| JP | 2004-334199 | A | 11/2004 |
| JP | 2006-243437 | A | 9/2006 |

(Continued)

OTHER PUBLICATIONS

European Search Report, EP 09003855.5, Jul. 9, 2010, 12 pages.

*Primary Examiner* — Hau Nguyen
*Assistant Examiner* — Ryan M Gray
(74) *Attorney, Agent, or Firm* — Innovation Counsel LLP

(57) ABSTRACT

One or more embodiments of the present invention relate to a four color image display device. A display device according to an exemplary embodiment of the present invention includes a first pixel adapted to display a first color, a second pixel adapted to display a second color, a third pixel adapted to display a third color, and a white pixel adapted to display a first white. In one aspect, the first to third pixels are adapted to display a second white in combination, and a ratio of the first white and the second white varies according to a gray. Accordingly, a greenish phenomenon of a low-luminance white light in a four color display device may be reduced.

6 Claims, 11 Drawing Sheets

(56) References Cited

FOREIGN PATENT DOCUMENTS

| | | | |
|---|---|---|---|
| JP | 2006-243439 | A | 9/2006 |
| JP | 2006-267149 | A | 10/2006 |
| JP | 2006-308685 | A | 11/2006 |
| JP | 2007-206560 | A | 8/2007 |
| JP | 2008-026339 | A | 2/2008 |
| KR | 1020040061200 | A | 7/2004 |
| KR | 1020040096273 | A | 11/2004 |
| KR | 1020060088892 | A | 8/2006 |
| KR | 1020060134369 | A | 12/2006 |
| KR | 1020070101545 | A | 10/2007 |
| KR | 1020070121163 | A | 12/2007 |
| KR | 1020080009497 | A | 1/2008 |
| WO | 0137249 | A2 | 5/2001 |

* cited by examiner

FOUR COLOR DISPLAY DEVICE AND METHOD OF CONVERTING IMAGE SIGNAL THEREOF

CROSS-REFERENCE TO RELATED APPLICATION

This is a divisional patent application of U.S. patent application Ser. No. 12/411,576, filed on Mar. 26, 2009, which application claims priority to and the benefit of Korean Patent Application No. 10-2008-0100832, filed in the Korean Intellectual Property Office on Oct. 14, 2008, the entire contents of each of which are incorporated herein by their references.

BACKGROUND

1. Technical Field

The present invention relates to a four color display device and a method of converting an image signal thereof.

2. Related Art

Recently, an organic light emitting display device and a flat panel display have been actively developed. Such a flat panel display typically displays images based on three primary colors of red, green, and blue, and a white pixel may be added for the purpose of luminance enhancement. Such a four color flat panel display converts three input color image signals into four color image signals and displays an image based on the converted signals.

There are several methods of converting the three color image signals into the four color image signals. One of the methods converts each of the three color input image signals into luminance signals, defines a minimum value among values of the three luminance signals as a value of a white luminance signal, and then subtracts the minimum value from each of the three luminance signals. The four luminance signals are back-converted into image signals, thereby forming four color image signals.

However, a white pixel of a four color organic light emitting display device includes a white organic emission layer. A color coordinate of white light emitted from a white organic emitting layer made of a conventionally used material is biased to green at a low luminance. In other words, a greenish phenomenon of a low-luminance white may be shown, which may degrade the displayed image.

The above information disclosed in this Background section is only for enhancement of understanding of the background of the invention and therefore it may contain information that does not form the prior art that is already known in this country to a person of ordinary skill in the art.

SUMMARY

Embodiments of the present invention have been made in an effort to reduce the greenish phenomenon of white light having low luminance in a four color display device, and particularly, in a four color organic light emitting display device.

An exemplary embodiment of the present invention provides a display device having a first pixel that displays a first color, a second pixel that displays a second color, a third pixel that displays a third color, and a white pixel that displays a first white. The first to third pixels display a second white in combination, and a ratio of the first white and the second white varies according to a gray.

The first white and the second white may be different from each other in terms of color coordinates. The first white may be different in view of the color coordinates according to a gray, and the color coordinates of the first white may approach the color coordinates of the second white as the gray becomes higher.

The ratio of the first white and the second white may be higher at a high gray compared to a low gray, and particularly, if the gray is smaller than a predetermined value, the second white may be 100% and if the gray is higher than a predetermined value, the first white may be 100%. The ratio of the first white may be continuously changed according to the gray.

Another exemplary embodiment of the present invention provides a display device, which converts three color input image signals into three color output image signals and four output image signals including a white output image signal and displays the converted signals. The display device comprises an arranging unit that arranges the input image signals in a gray order and obtains a maximum input gray, a middle input gray, and a minimum input gray; a gamma converter that gamma-converts the maximum input gray, the middle input gray, and the minimum input gray and generates a maximum input luminance, a middle input luminance, and a minimum input luminance; a calculator that obtains a white output luminance from the minimum input luminance, and converts the maximum input luminance, the middle input luminance, and the minimum input luminance based on the white output luminance to obtain a maximum output luminance, a middle output luminance, and a minimum output luminance; a de-gamma converter that de-gamma-converts the white output luminance, the maximum output luminance, the middle output luminance, and the minimum output luminance and obtains a white output gray, a maximum output gray, a middle output gray, and a minimum output gray; a rearranging unit that rearranges the arrangement order of the maximum output gray, the middle output gray, and the minimum output gray and generates the four color output image signals; and four color pixels that perform a display operation according to the four color output image signals, wherein the white output luminance is a non-linear function of the minimum input luminance with respect to at least some values.

Each of the maximum output luminance, the middle output luminance, and the minimum output luminance may have values that are obtained by subtracting the white output luminance from the maximum input luminance, the middle input luminance, and the minimum input luminance. If the minimum input luminance is smaller than a predetermined value, the white output luminance may be 0, and if the minimum input luminance is larger than a predetermined value, the white output luminance may have the same value as the minimum input luminance.

The white output luminance may be a continuously increasing function of the minimum input luminance. The white output luminance WhtOut and the minimum input luminance MinIn can satisfy the following equation.

$$\mathrm{WhtOut}=(\mathrm{MinIn})^{a\times b}$$

(where a is a constant larger than 1 and b is any constant)

where a=2 and b=1.

The continuously increasing function may have an inflection point. The calculator may include a lookup table that converts the minimum input luminance into the white output luminance and an adder that obtains the maximum output luminance, the middle output luminance, and the minimum output luminance based on the white output luminance. A relationship between the minimum input luminance and the white output luminance that are stored in the lookup table may be defined by experiments.

In accordance with one or more embodiments of the present invention, the greenish phenomenon of the low luminance white light in the four color display device may be reduced, which may improve the quality of the displayed image.

DETAILED DESCRIPTION

The present invention will be described more fully hereinafter with reference to the accompanying drawings, in which exemplary embodiments of the invention are shown. As those skilled in the art should realize, the described embodiments may be modified in various different ways, without departing from the spirit or scope of the present invention.

Figure 1:
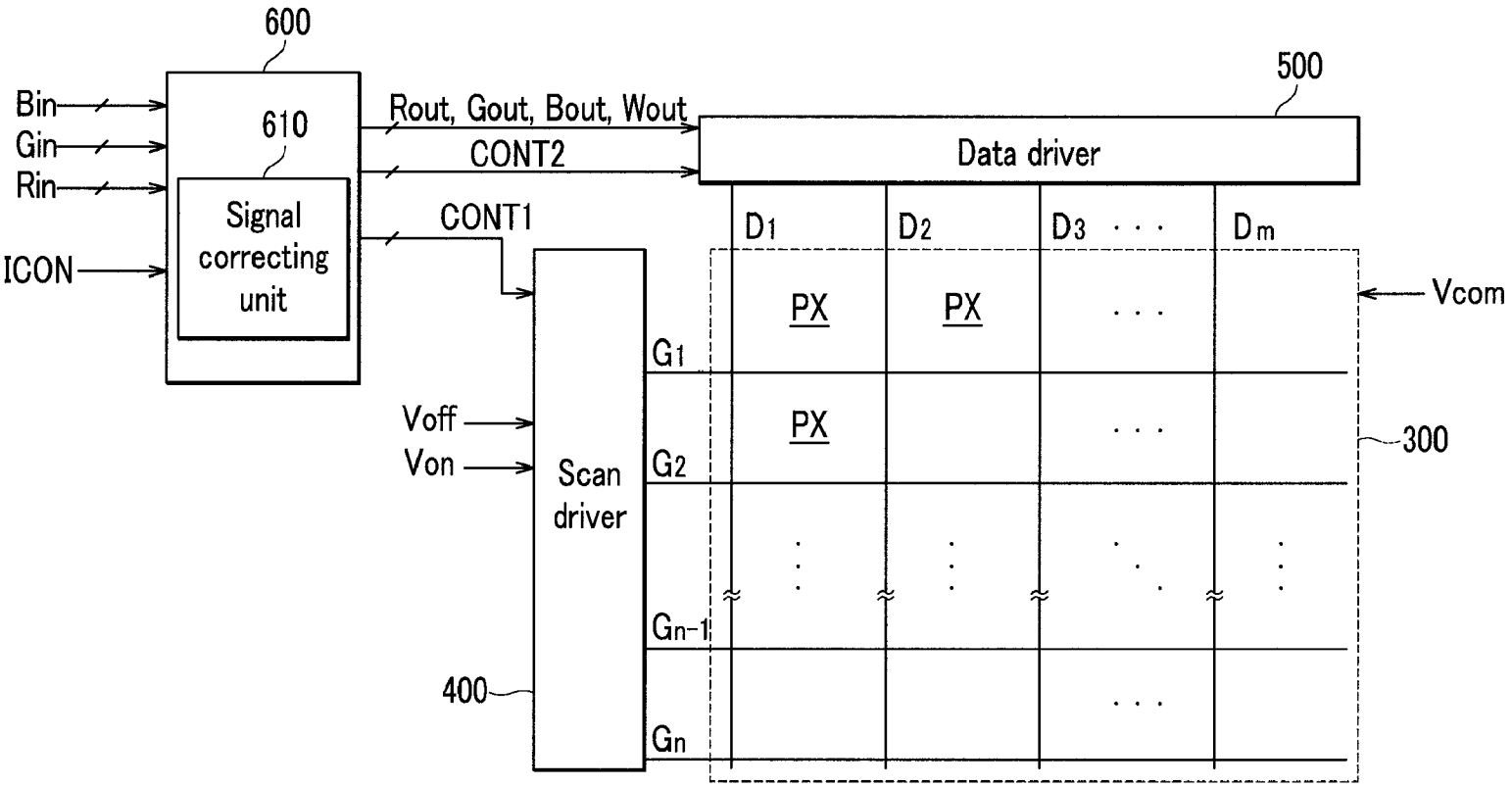
FIG. 1 is a block diagram of a four color display device, according to an exemplary embodiment of the present invention.
Figure 2:
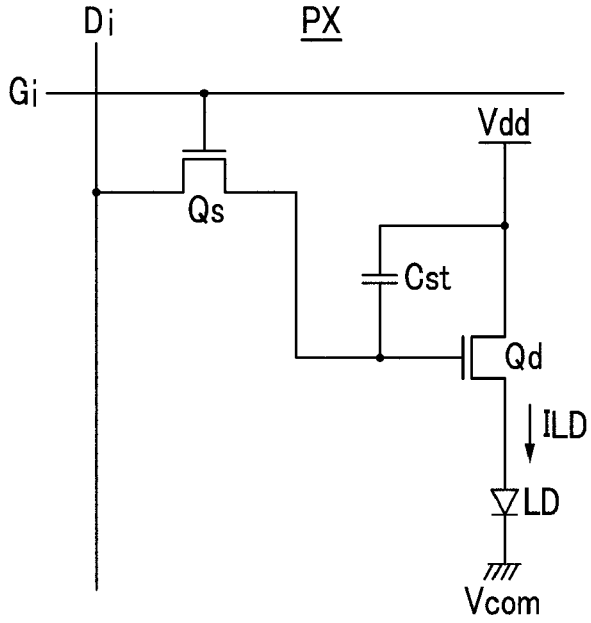
FIG. 2 is an equivalent circuit diagram of one pixel in an organic light emitting display device, according to an exemplary embodiment of the present invention.
Figure 3:
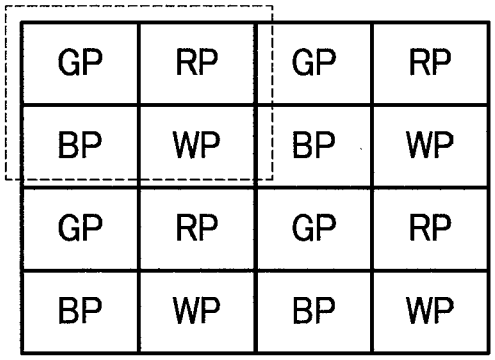
FIG. 3 is a diagram showing a pixel arrangement of the four color display device, according to an exemplary embodiment of the present invention.

A display device according to an exemplary embodiment of the present invention is described in reference to FIGS. 1 to 3.

FIG. 1 is a block diagram of a four color display device, according to an exemplary embodiment of the present invention, FIG. 2 is an equivalent circuit diagram of one pixel in an organic light emitting display device, according to an exemplary embodiment of the present invention, and FIG. 3 is a diagram showing a pixel arrangement of the four color display device, according to an exemplary embodiment of the present invention.

The display device, according to an exemplary embodiment of the present invention, includes a display panel unit 300, a scan driver 400, a data driver 500, and signal controller 600. Referring to FIG. 1, a display panel unit 300 includes a plurality of signal lines G1 to Gn and D1 to Dm and a plurality of pixels PX that are connected to the plurality of signal lines G1 to Gn and D1 to Dm and are arranged in a matrix form, when viewing from an equivalent circuit perspective.

The signal lines G1 to Gn and D1 to Dm include a plurality of scanning lines G1 to Gn that transfer scanning signals and a plurality of data lines D1 to Dm that transfer data signals. The scanning lines G1 to Gn approximately extend in a row direction and are approximately parallel with each other, and the data lines D1 to Dm approximately extend in a column direction and are approximately parallel with each other.

As one example of the display device, referring to FIG. 2 that shows a pixel of an organic light emitting display device, each pixel PX, for example, a pixel PX that is connected to an i-th scanning line Gi (i=1, 2, n) and a j-th data line Dj (j=1, 2, m), includes an organic light emitting element LD, a driving transistor Qd, a capacitor Cst, and a switching transistor Qs.

A switching transistor Qs is a three-terminal element that has a control terminal, an input terminal, and an output terminal. The control terminal is connected to a scanning line Gi, the input terminal is connected to a data line Dj, and the output terminal is connected to a control terminal of a driving transistor Qd. Such a switching transistor Qs responds to a scanning signal applied through the scanning line Gi to transfer a data voltage.

The driving transistor Qd is also the three-terminal element that has a control terminal, an input terminal, and an output terminal. The control terminal is connected to a switching transistor Qs, the input terminal is connected to a driving voltage Vdd, and the output terminal is connected to an organic light emitting element LD. Such a driving transistor Qd applies an output current ILD with a magnitude that varies according to a voltage applied between the control terminal and the output terminal.

The capacitor Cst is connected between the control terminal and the input terminal of the driving transistor Qd input terminal. The capacitor Cst charges the data voltage applied to the control terminal of the driving transistor Qd through the switching transistor Qs, and maintains the data voltage even after the switching transistor Qs is turned off.

In one embodiment, the organic light emitting element (LD) may comprise an organic light emitting diode (OLED) and may include an anode that is connected to the output terminal of the driving transistor Qd and a cathode that is connected to a common voltage Vcom. The organic light emitting element LD is light-emitted at different intensities according to the output current ILD to display images.

The organic light emitting element LD emits at least one primary color and white. For example, the primary colors may include at least one of three primary colors including red (R), green (G), and blue (B). In one aspect, a desired color may be displayed by spatially synthesizing the three primary colors, and the white light may be added to the synthesized light such that the overall luminance is improved.

In one implementation, the organic light emitting element LD of all the pixels PX may emit white light. In this case, some pixels PX may include a color filter (not shown) that converts the white light from the organic light emitting element LD into any one among the primary colors. Hereinafter, the pixels emitting red, green, blue, and white light will be referred to as a red pixel RP, a green pixel GP, a blue pixel BP, and a white pixel WP, respectively.

Referring to FIG. 3, the red pixel RP, the green pixel GP, the blue pixel BP, and the white pixel WP are arranged in a 2×2 matrix form. A set of such arranged pixels is called a "dot" and is a basic unit that displays the images.

The display device comprises a structure where the dots are repeatedly arranged in a row direction and a column direction. Within each dot, the red pixel RP and the blue pixel BP face each other in a diagonal direction, and the green pixel GP and the white pixel WP face each other in a diagonal direction.

When the green pixel GP and the white pixel WP face each other in a diagonal direction, the color characteristic of the display device is optimal. However, the four color pixels RP, GP, BP, and WP may have a stripe arrangement, a pentile arrangement, etc., in addition to a matrix arrangement of FIG. 3.

The switching transistor Qs and the driving transistor Qd are n-channel field effect transistors (FETs) that are made of amorphous silicon or polycrystalline silicon. However, at least one of the transistors Qs and Qd may be a p-channel field effect transistor. In one aspect, the connection relationship of the transistors Qs and Qd, capacitor Cst, and organic light emitting element LD can be changed.

Referring to FIG. 1, the scan driver 400 is connected to the scanning lines G1 to Gn of the display panel unit 300 and applies the scanning signals that are formed of a combination of a high voltage Von that is capable of turning on the switching transistor Qs and a low voltage Voff that is capable of turning off the switching transistor Qs to the scanning lines G1 to Gn, respectively. The data driver 500 is connected to the data lines D1 to Dm of the display panel unit 300, and applies the data signals representing the image signals to the data lines D1 to Dm.

The signal controller 600 controls the operations of a scan driver 400, the data driver 500, etc., and includes a signal correcting unit 610. The signal correcting unit 610 generates four color output image signals (Rout, Gout, Bout, and Wout) from the three color input image signals Rin, Gin, and Bin.

Each of the drivers 400, 500, and 600 is directly mounted on the display panel unit 300 in a form of at least one IC chip or is mounted on the flexible printed circuit film (not shown), such that they may be mounted on the display panel unit 300 in a form of a tape carrier page (TCP) or on a printed circuit board (PCB) (not shown). Unlike this, these drivers 400, 500, and 600 can be integrated on the display panel unit together with the signal lines G1 to Gn and D1 to Dm, the transistor Qs and Qd, etc. Further, the drivers 400, 500, and 600 can be integrated in a single chip. In this case, at least one circuit element forming these drivers may be outside the single chip.

Hereinafter, the operation of the display device will be described. The signal controller 600 receives three color signals from an external graphics controller (not shown), for example input image signals Rin, Gin, and Bin of red, green, and blue, and an input control signal ICON that controls a display thereof. The input image signals Rin, Gin, and Bin include luminance information of each pixel PX, and the luminance has a predetermined number of grays, for example 1024 ($=2^{10}$), 256 ($=2^{8}$), or 64 ($=2^{6}$). As an example of the input control signal (ICON), there are a vertical synchronization signal, a horizontal synchronizing signal, a main clock signal, a data enable signal, etc.

The signal correcting unit 610 of the signal controller 600 generates the red, green, blue, and white output image signals Rout, Gout, Bout, and Wout from the three color input image signals Rin, Gin, and Bin. The signal controller 600 generates the scan control signal CONT1 and the data control signal CONT2 based on the input image signals Rin, Gin, and Bin and the input control signal (ICON), and then transfers the scan control signal CONT1 to the scan driver 400 and the data control signal CONT2 and the output image signals Rout, Gout, Bout, and Wout to the data driver 500.

The scan control signal CONT1 includes a scanning start signal STV that instructs a scanning start and at least one clock signal that controls an output period of a high voltage Von. The scan control signal CONT1 may also further include an output enable signal OE that limits the duration of the high voltage Von.

The data control signal CONT2 includes a horizontal synchronization start signal STH that informs a transmission start of the digital output image signals Rout, Gout, Bout, and Wout for a pixel PX of one row, and a load signal LOAD that instructs application of an analog data voltage to the data lines D1 to Dm, and a data clock signal HCLK. The data driver 500 receives the four color output image signals Rout, Gout, Bout, and Wout according to the data control signal CONT2 from the signal controller 600 and converts the received signals into the analog voltage.

The scan driver 400 converts the scanning signals applied to the scanning lines G1 to Gn into the high voltage Von according to the scan control signal CONT1 from the scan controller 600. Thereby, the data voltage applied to the data lines D1 to Dm is applied to the corresponding pixel PX through the turned-on switching element Q, and the corresponding pixel PX performs the display based on the data voltage.

In the case of the organic light emitting display device shown in FIG. 2, the data voltage transferred by the switching transistor Qs is applied to the control terminal of the driving transistor Qd, and the driving transistor Qd outputs the driving current ILD corresponding to the applied data voltage to the organic light emitting element LD. The organic light emitting element LD light-emits light of a luminance corresponding to the driving current ILD. The process is repeated based on a horizontal period (referred to as "1H" that is the same as one period of the horizontal synchronizing signal Hsync and the data enable signal DE) as a unit, such that the high voltage Von is sequentially applied all the scanning lines G1 to Gn and the data voltage is applied to all the pixels PX, thereby displaying an images of one frame.

Figure 4:
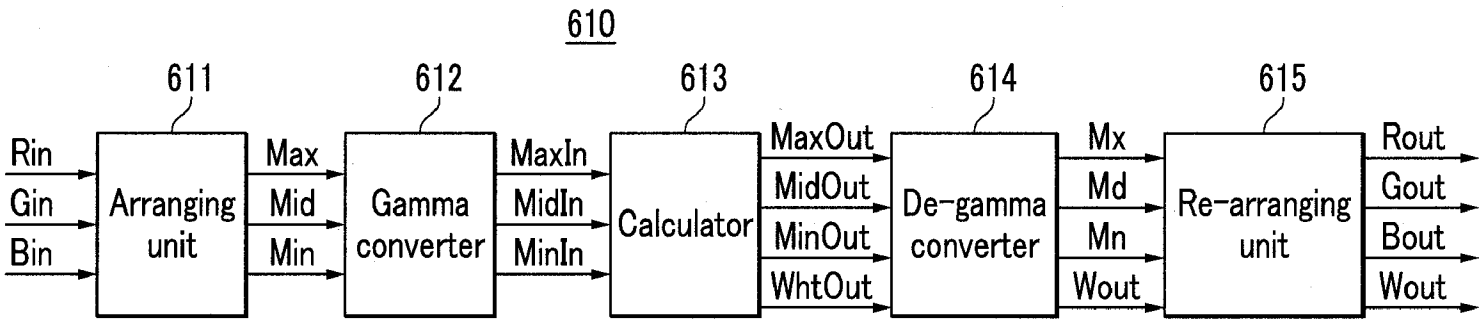
FIG. 4 is a block diagram of a signal correcting unit, according to an exemplary embodiment of the present invention.

Hereinafter, the signal correcting unit according to an exemplary embodiment of the present invention will be described with reference to FIG. 4. FIG. 4 is a block diagram of the signal correcting unit according to an exemplary embodiment of the present invention. As shown in FIG. 4, the signal correcting unit 610 according to the present exemplary embodiment includes an arranging unit 611, a gamma converter 612, a calculator 613, a de-gamma converter 614, and a rearranging unit 615.

The arranging unit 611 compares the grays of the three input image signals corresponding to the four pixels RP, GP, BP, and WP forming one dot, that is, the grays of the red input signal Rin, the green input signal Gin, and the blue input signal Bin, thereby arranging them in a size sequence. FIG. 4 shows the maximum input gray, the middle input gray, and the minimum input gray, respectively, as Max, Mid, and Min.

The gamma converter 612 gamma-converts the Max, Mid, and Min, respectively, to obtain MaxIn, MidIn, and MinIn. Each of the MaxIn, MidIn, and MinIn is obtained by standardizing the luminance of the maximum input image signal, the middle input image signal, and the minimum input image signal. Hereinafter, they are referred to as the maximum input luminance, the middle input luminance, and the minimum input luminance, respectively.

The calculator 613 obtains the luminance WhtOut of the white output image signal Wout (hereinafter, referred to as "white output luminance") and obtains the luminance corresponding to the maximum output gray Mx, the middle output gray Mn, and the minimum output gray Mn by subtracting the white luminance Wht_Gm from MaxIn, MidIn, and MinIn, that is, the maximum output luminance MaxOut, the middle output luminance MidOut, and the minimum output luminance MinOut, respectively. MaxOut, MidOut, and MinOut also have standardized values.

$$WhtOut=f(MaxIn, MidIn, MinIn)$$

$$MaxOut=MaxIn-WhtOut$$

$$MidOut=MidIn-WhtOut$$

$$MinOut=MinIn-WhtOut \quad \text{[Equation 1]}$$

The de-gamma converter 614 de-gamma converts the four luminances obtained according to the above-mentioned process to obtain the grays of the maximum output image signal, the middle output image signal, the minimum output image signal, and the white output image signal.

The rearranging unit 615 rearranges their sequence to obtain the output signals Rout, Gout, Bout, and Wout of red, green, blue, and white. However, when the increase of the luminance that is generated due to the addition of the white pixel WP is reflected, the relationship equation may be realized as follows.

$$WhtOut=f(MaxIn, MidIn, MinIn)$$

$$MaxOut=s\times(MaxIn-WhtOut)$$

$$MidOut=s\times(MidIn-WhtOut)$$

$$MinOut=s\times(MinIn-WhtOut) \quad \text{[Equation 2]}$$

Herein, s is magnification reflecting the increase of the luminance and has a value larger than 1. Hereinafter, several rules defining the white output luminance WhtOut will be described in detail with reference to FIGS. 5 to 9.

A ground rule that is a reference defining these rules should reduce an amount of light emitted from the white pixel WP contributing to the entire luminance by making the white luminance small in the case of the low gray. Thereby, the deterioration of the image quality due to a phenomenon in which the white light emitted from the white pixel WP in the case of the low gray deviates from the targeted color coordinate, particularly a greenish phenomenon, can be reduced.

For example, the same amount of light emitted from the red, green, and blue pixels RP, GP, and BP is summed, such that the white light is made. The white light emitted from the white pixel WP and the white light emitted from the three color pixels RP, GP, and BP in combination may be different from each other in view of color coordinates. Assume that the white emitted from the white pixel WP is the first white and the white emitted from the three color pixels RP, GP, and BP in combination is the second. When the gray is relatively high, the color coordinates of the first white and the second white are approximately the same, but when the gray is low, the color coordinates of the first white may be far different from the color coordinates of the second white. In other words, the color coordinates of the first white vary according to the gray, and particularly when the gray is low, may be far different from the targeted color coordinates. Particularly, in the case of the organic light emitting device, when the gray is low, the color coordinates of the first gray move toward the green side, thereby causing the greenish phenomenon. Therefore, when the gray is low, the ratio of the first white to the second white should be lowered, and as the gray becomes high, the ratio of the first white to the second white should be increased. This will be described in detail herein.

In the case of the conventional art, the white output luminance WhtOut is defined as the minimum input luminance MinIn independently of the gray. In other words, the relationship between the white output luminance WhtOut and the minimum input luminance MinIn is linear. However, in the present exemplary embodiment, the white output luminance WhtOut becomes a non-linear function with respect to at least some value of the minimum input luminance MinIn.

In one aspect, the simplest method sets the white output luminance WhtOut to 0 if the minimum input luminance MinIn is smaller than a predetermined value, and sets the white output luminance WhtOut to be the same as the minimum input luminance MinIn if the minimum input luminance MinIn is larger than a predetermined value. This is reflected in the following Equation 3.

$$WhtOut=0\ (MinIn<\alpha),$$

$$WhtOut=MinIn\ (MinIn\geq\alpha).$$

$$\text{If } MinIn<\alpha, \quad \text{[Equation 3]}$$

$$WhtOut=0$$

$$MaxOut=MaxIn$$

$$MidOut=MidIn$$

$$MinOut=MinIn$$

$$\text{and if } MinIn\geq\alpha, \quad \text{[Equation 4]}$$

$$WhtOut=MinIn$$

$$MaxOut=MaxIn-MinIn$$

$$MidOut=MidIn-MinIn$$

$$MinOut=0 \quad \text{[Equation 5]}$$

Figure 5A:
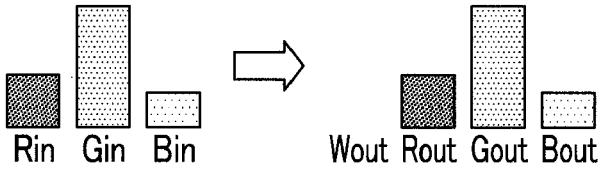
FIG. 5 is a diagram schematically showing a four-color converting method, according to an exemplary embodiment of the present invention.
Figure 5B:
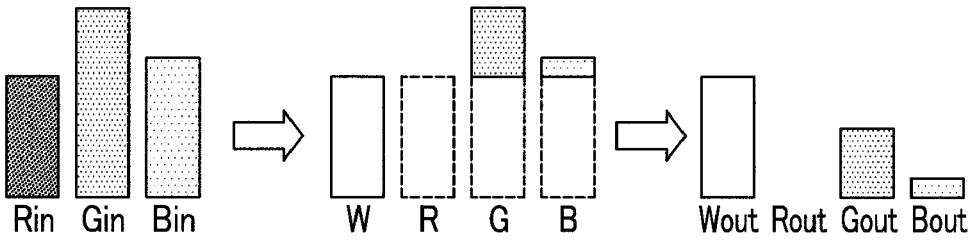

According to an embodiment of the present invention, FIG. 5 is a diagram schematically showing the foregoing concepts. If $MinIn<\alpha$, the white output image signal is 0 and the output image signals Rout, Gout, and Bout of red, green, and blue are the same as the red, green, and blue input image signals Rin, Gin, and Bin. If $MinIn\geq\alpha$, the white output image signal is the same as the minimum input image signal, and the minimum output image signal is 0 and the maximum and middle output image signals have a size to some degree.

Figure 6:
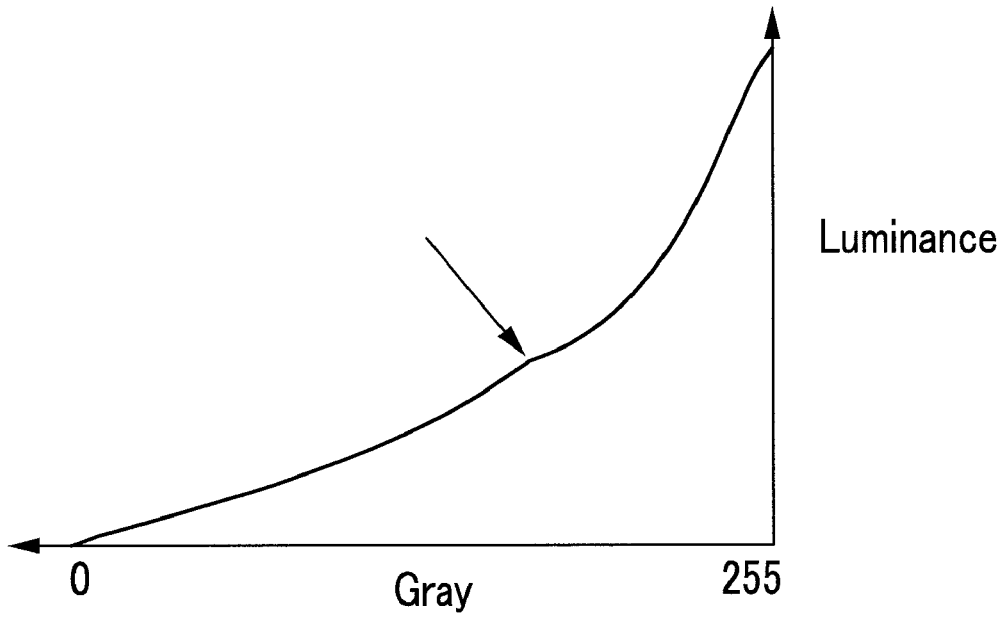
FIG. 6 is a graph showing luminance of white light, which is obtained by the four-color converting method of FIG. 5, using a gray function, according to exemplary embodiments of the present invention.

According to an embodiment of the present invention, FIG. 6 shows the luminance of the red, green, blue, and white output image signals Rout, Gout, Bout, and Wout according to the grays when the grays of the red, green, and blue input image signals Rin, Gin, and Bin are the same, and shows that singularity appears at one point. The singularity appears when the luminance of the input image signals Rin, Gin, and Bin is $\alpha$. When the luminance of the input image signals Rin, Gin, and Bin is smaller than a, only the red, green, and blue pixels RP, GP, and BP are displayed, and if the luminance of the input image signals Rin, Gin, and Bin is larger than $\alpha$, only the white pixel WP is displayed, such that the singularity occurs.

In one aspect, to remove the singularity as shown in FIG. 6, the white output luminance WhtOut may be defined as a continuous increasing function. For example, the white output luminance WhtOut may be defined as a square function of the minimum input luminance MinIn.

$$WhtOut=(MinIn)^2=MinIn\times MinIn$$

$$MaxOut=MaxIn-(MinIn)^2$$

$$MidOut=MidIn-(MinIn)^2$$

$$MinOut=MinIn-(MinIn)^2 \quad \text{[Equation 6]}$$

Figure 7:
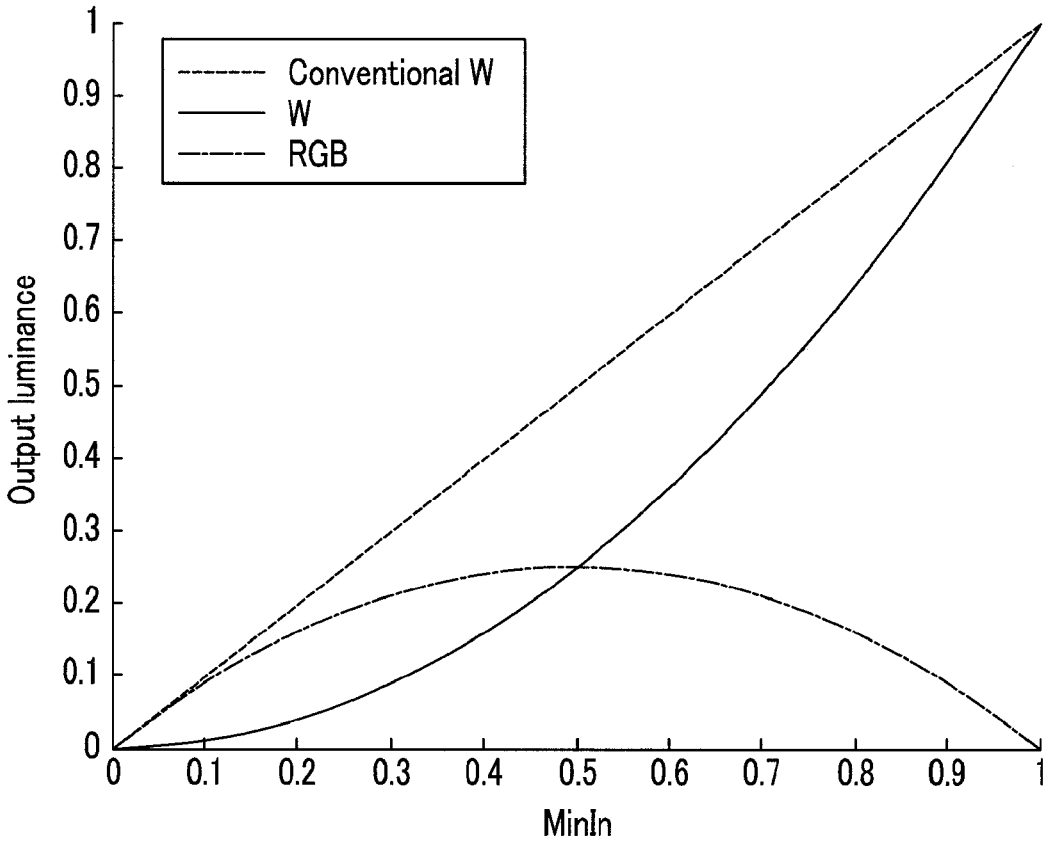
FIGS. 7 to 9 are graphs showing a white output luminance using a minimum input luminance in the four-color converting method, according to an exemplary embodiment of the present invention.

According to an embodiment of the present invention, FIG. 7 shows the white output luminance White, the three color output luminance RGB, and the conventional white output luminance [White(conventional)] as the function of the minimum input luminance MinIn. The conventional white output luminance is the white output luminance when WhtOut=MinIn.

Figure 8:
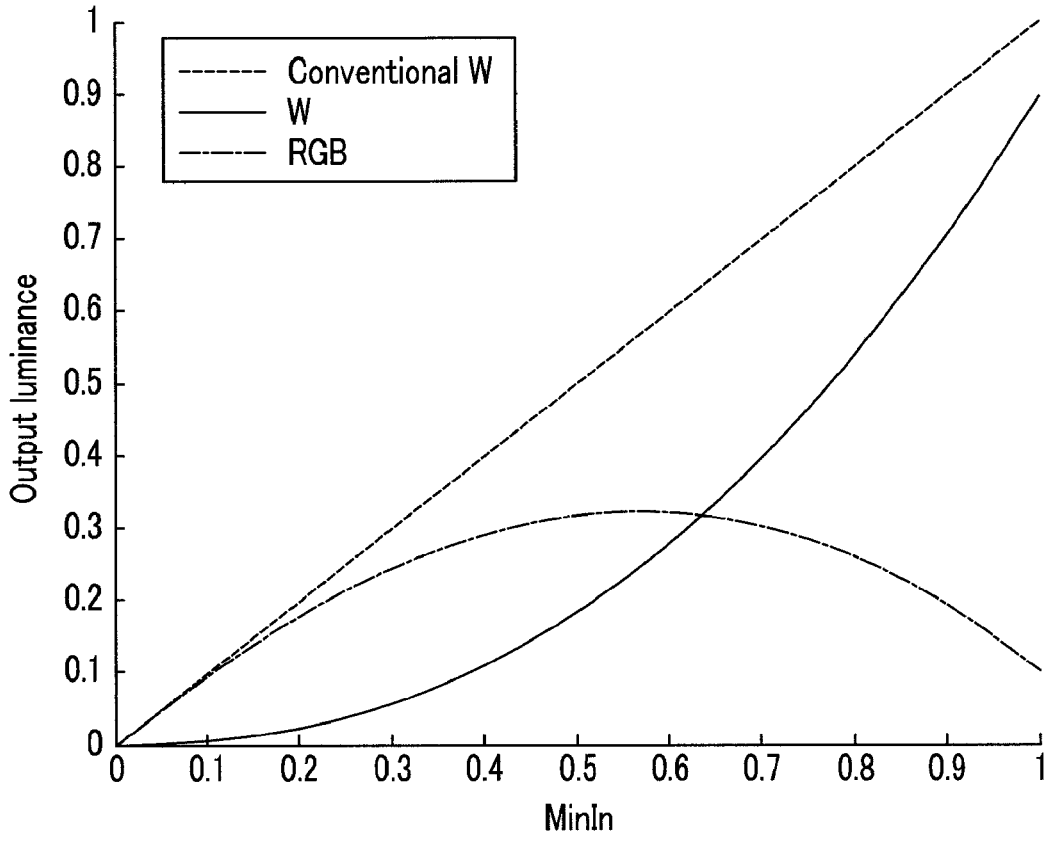

Thereby, in the low gray, the ratio in charge of the three different pixels RP, GP, and BP is higher than that of the white pixel WP, but as the gray becomes high, the ratio in charge of the white pixel WP is high, making it possible to supplement a poor light characteristic of the white pixel WP in the low gray. This is generally represented as follows.

$$\text{WhtOut}=(\text{MinIn})^{a\times b} \quad \text{[Equation 7]}$$

where a>1 and a and b can be optionally selected. For example, FIG. 8 shows a case of a=2.3 and b=0.9.

In addition to the method of obtaining the output luminance MaxOut, MidOut, MinOut, and WhtOut, the four-color conversion can be performed by obtaining appropriate values for each gray or luminance through experiments, storing them in the lookup table, and then utilizing them. Thereby, the four-color conversion can be further appropriately performed and is more efficient since there is no calculation process. In this case, the input image signal can be directly converted into the output image signal without subjecting to the gamma conversion or the de-gamma conversion.

Figure 9:
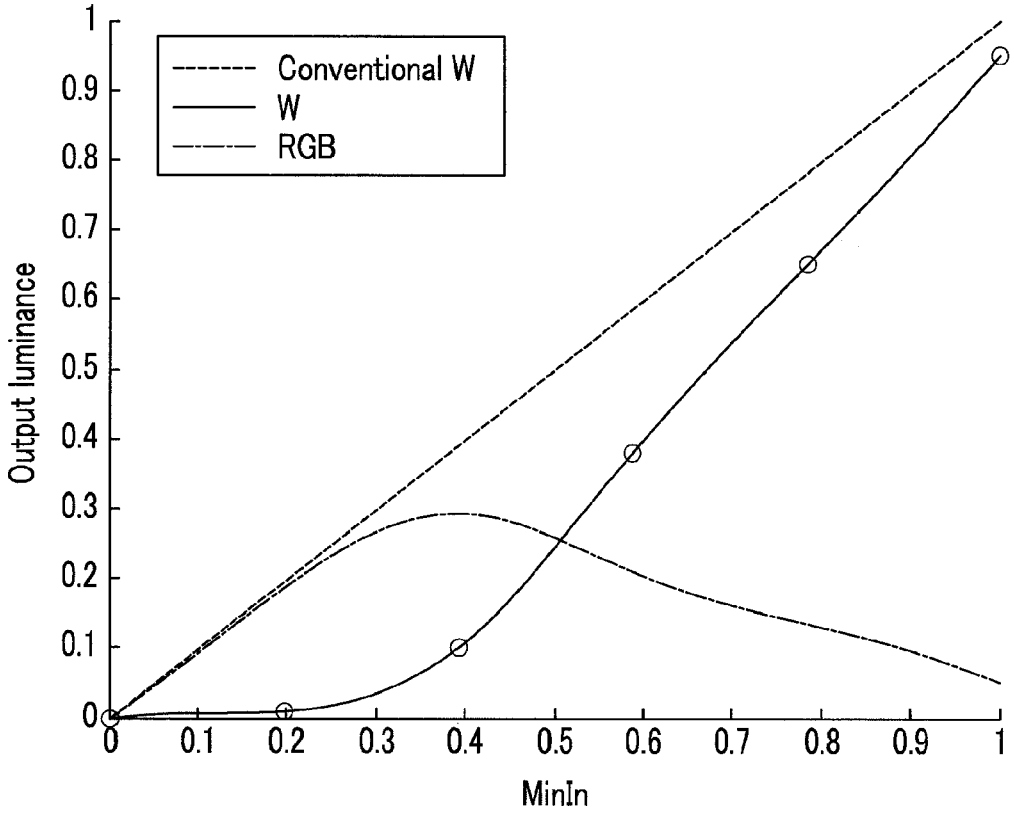

One example is shown in FIG. 9, and it can be appreciated that the shape of the curved line is approximately an S-letter shape since there is an inflection point in the curved line showing the white output luminance WhtOut.

Figure 10:
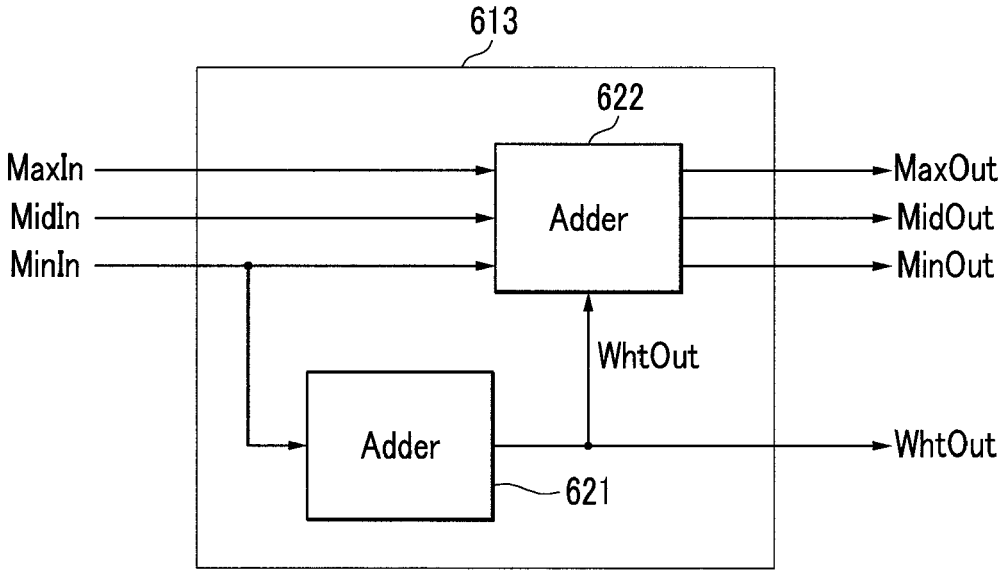
FIG. 10 is a block diagram of a calculator, according to an exemplary embodiment of the present invention.

According to an embodiment of the present invention, FIG. 10 is an example showing the four-color conversion process utilizing the lookup table, wherein the calculator 613 includes a lookup table 621 and an adder 622. The white output luminance WhtOut is stored in the lookup table 621 as a function of the minimum input luminance MinIn that is obtained through experiments, etc., and for example it may have the relationship as shown in FIG. 9. Therefore, the lookup table 621 receives the minimum input luminance (MinIn) and converts it into the white output luminance WhtOut. The adder 622 receives the maximum, middle, and minimum input luminance MaxIn, MidIn, and MinIn from the gamma converter 612 and the white output luminance WhtOut from the lookup table 621 to obtain the maximum, middle, and minimum output luminance MaxOut, MidOut, and MinOut as shown in Equation 1.

Figure 11:
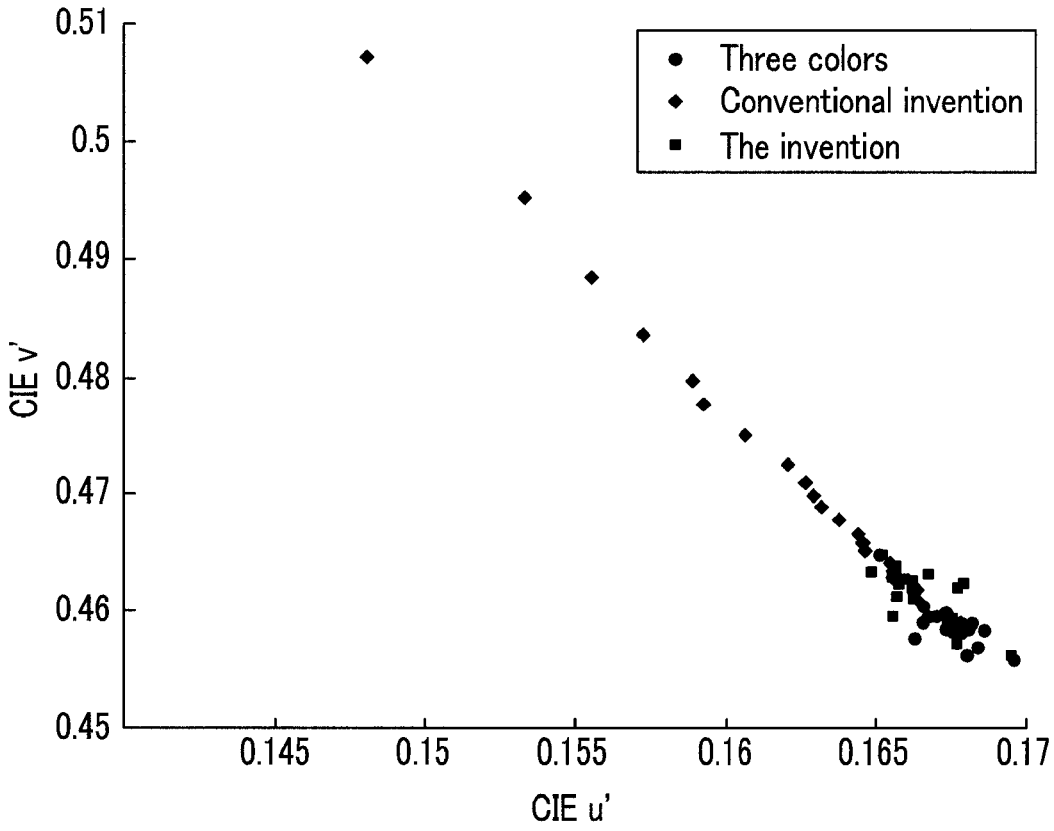
FIG. 11 is a graph showing color coordinates for each gray of a display device, according to an exemplary embodiment of the present invention.
Figure 12:
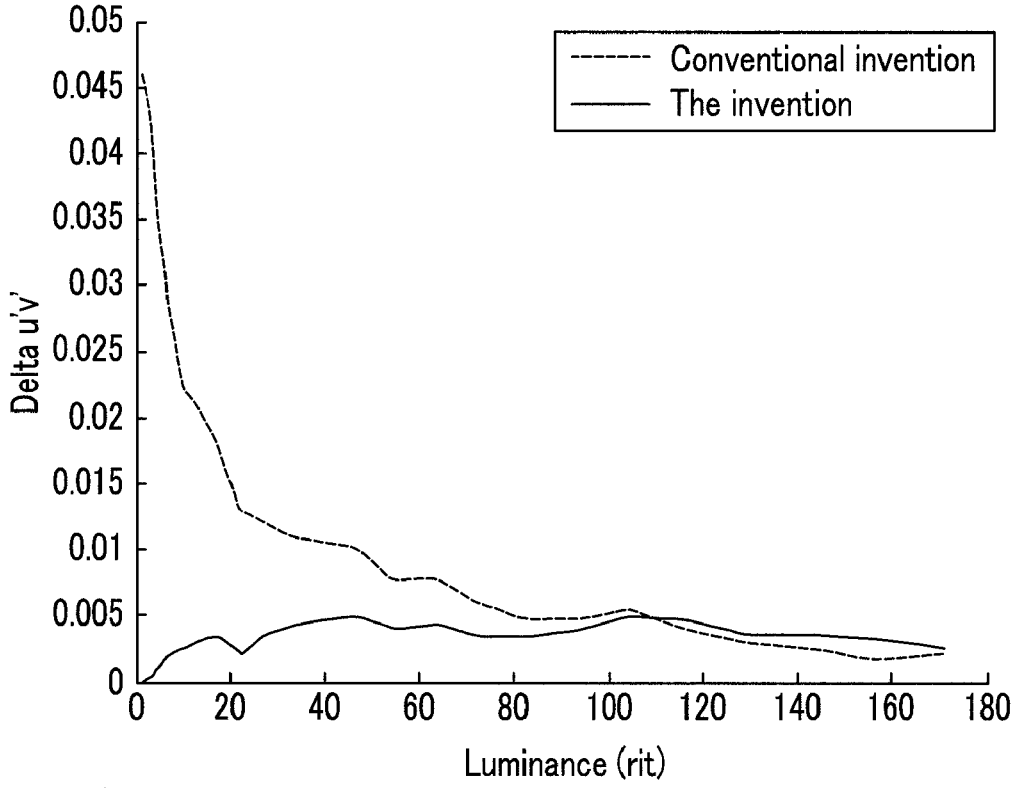
FIG. 12 shows a difference Δu'v' between the color coordinates of the display device using a luminance function, according to an exemplary embodiment of the present invention.

According to embodiments of the present invention, FIG. 11 compares the color coordinates (CIE 1976) for each gray of the display device according to the present exemplary embodiment with the three color display device and the conventional four color display device, and FIG. 12 shows the difference Δu'v' between the color coordinates of the display device according to the present exemplary embodiment as the luminance function. The color coordinates shown in FIGS. 11 and 12 are obtained through the four-color conversion method defined as in FIG. 9, and the one represented by "conventional" is a case of the four color display device defining the white output luminance WhtOut as the minimum input luminance MinIn regardless of the gray.

It should be appreciated from FIGS. 11 and 12 that the change in the color coordinate according to the gray and luminance in the four color display device according to the present exemplary embodiment is smaller than in the conventional four color display device. The above-mentioned conversion method can be applied to the organic light emitting device as well as other display, and can be usefully used in all cases where the color characteristic of the white pixel is deteriorated in the low gray.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An organic light emitting display device comprising:
a first pixel to display a first color;
a second pixel to display a second color;
a third pixel to display a third color; and
a white pixel to display a first white,
wherein the first to third pixels are configured to display a second white in combination, and
wherein the first white is arranged to be set to zero when a minimum gray value of the first, second and third colors is less than a predetermined value, and is arranged to be set to the minimum gray value when the minimum gray value is equal to or greater than the predetermined value, so that a ratio of the first white to the second white is arranged to vary according to the minimum gray value, so as to thereby reduce a green color of a low luminance white light in the organic light emitting display device.

2. The display device of claim 1, wherein the first white and the second white may be different from each other.

3. The display device of claim 2, wherein color coordinates of the first white are arranged to vary according to the minimum gray value.

4. The display device of claim 3, wherein the color coordinates of the first white approach color coordinates of the second white as the minimum gray value increases.

5. The display device of claim 4, wherein the ratio of the first white to the second white is higher at a high value of the minimum gray value as compared to a low value of the minimum gray value.

6. The display device of claim 5, wherein the ratio of the first white to the second white is arranged to vary according to the minimum gray value.

* * * * *